United States Patent [19]

Kohn

[11] 4,417,600

[45] Nov. 29, 1983

[54] SAFETY VALVE

[75] Inventor: Gary A. Kohn, Dallas, Tex.

[73] Assignee: Otis Engineering Corporation, Dallas, Tex.

[21] Appl. No.: 332,927

[22] Filed: Dec. 21, 1981

Related U.S. Application Data

[63] Continuation-in-part of Ser. No. 131,793, Mar. 19, 1980, abandoned.

[51] Int. Cl.[3] ..... F16K 37/00; F16K 31/44

[52] U.S. Cl. ..... 137/553; 251/231; 251/292; 166/334; 175/218

[58] Field of Search ..... 175/218, 65; 166/332, 166/334; 251/231, 58, 291, 292, 242, 236; 137/553

*Primary Examiner*—A. Michael Chambers
*Attorney, Agent, or Firm*—Thomas R. Felger

[57] ABSTRACT

A manually operated valve. The valve has a housing with a uniform outside diameter compatible with the outside diameter of flow conductors attached to the valve. An operating sleeve is movable longitudinally within the housing by engagement with a shifting tool from the exterior of the housing. The operating sleeve shifts the valve between its open and closed positions. A detent spring is provided to give an indication when the shifting tool has moved the operating sleeve sufficient to fully open or close the valve. The valve is particularly adapted for using in a drill string or workover string in an oil or gas well.

27 Claims, 31 Drawing Figures

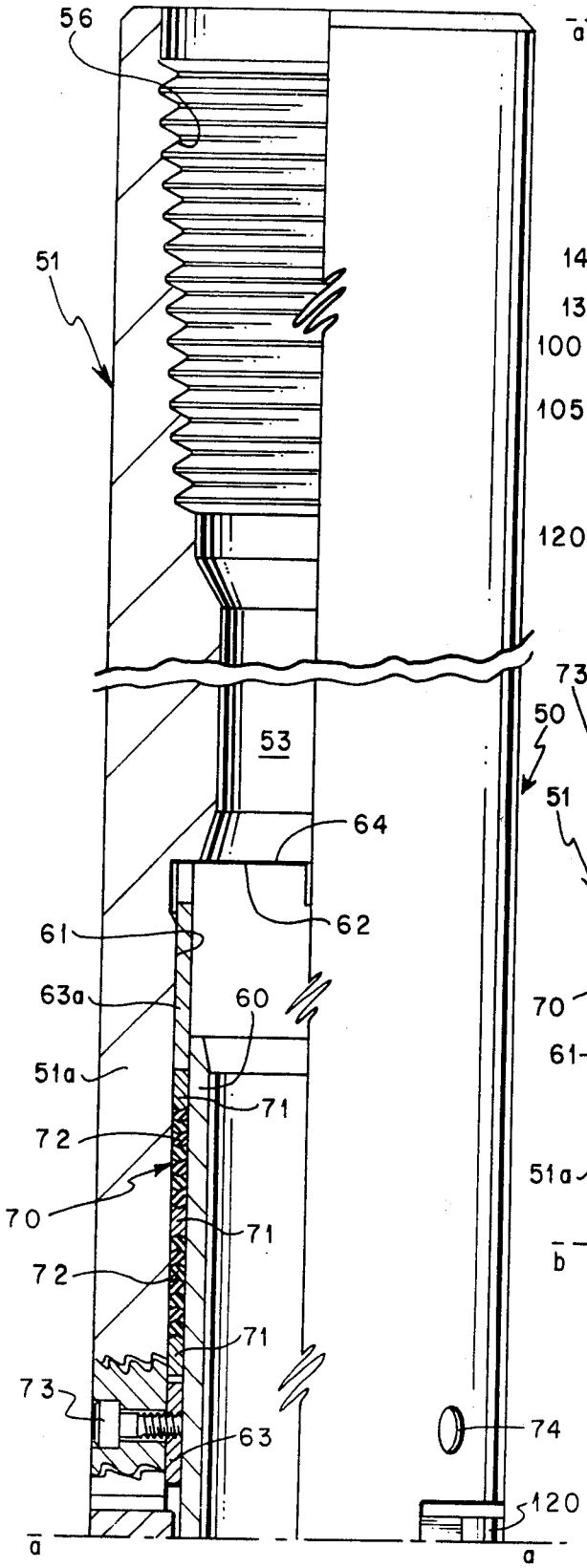
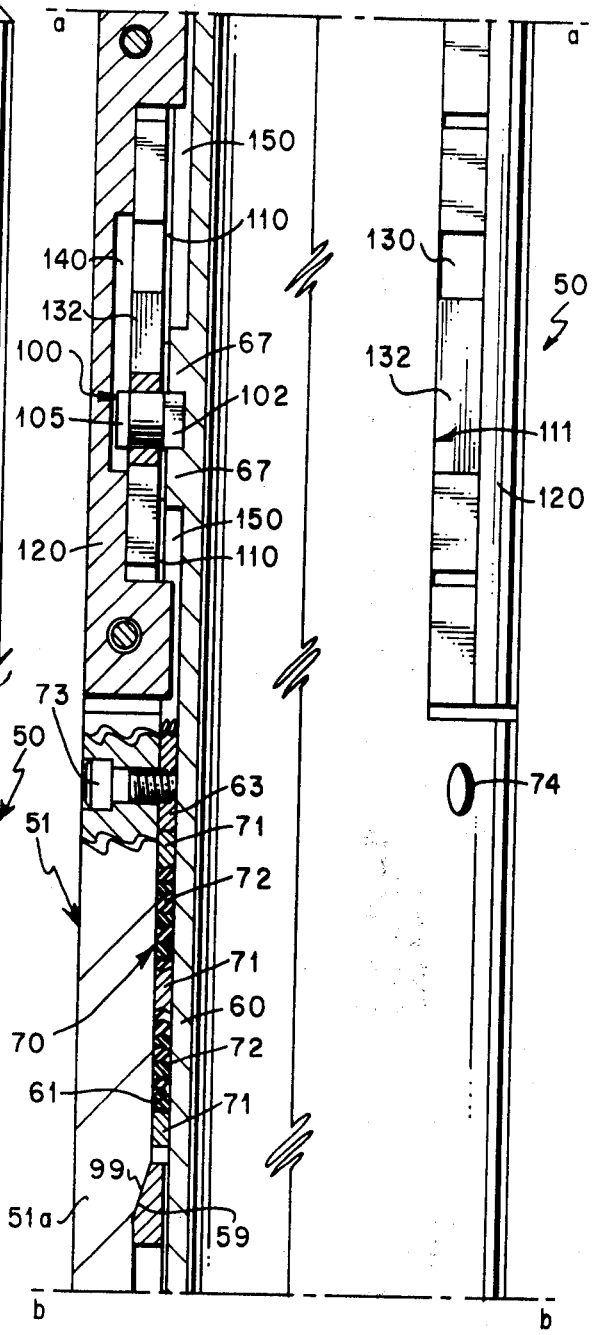
FIG. 3B
FIG. 3A

SAFETY VALVE

This application is a continuation-in-part of my copending application Ser. No. 06/131,793 filed on Mar. 19, 1980, now abandoned.

BACKGROUND OF THE INVENTION

1. Field of the Invention

The present invention discloses a safety valve which is manually operated. The present invention can be installed in drill strings and/or workover strings used in oil and gas wells.

2. Description of the Prior Art

While drilling an oil or gas well, the downhole pressure of formation fluids is normally controlled by circulating drilling mud through the well bore. The normal mud flow path is down through the bore of the drill string and up the annulus between the exterior of the drill string and the inside diameter of the well bore. Various types of blowout preventers are available to seal against the exterior of the drill string at the well surface to prevent undesired formation fluid flow from the annulus.

Formation fluids may also flow upward through the bore of the drill string if the downhole pressure of the formation fluid exceeds the hydrostatic pressure of the drilling mud.

U.S. Pat. No. 3,036,590 to Granville S. Knox discloses a manually operated valve which can be installed in the drill and/or tubing string at the well surface. As noted in U.S. Pat. No. 3,036,590, the outside diameter of this valve is enlarged with respect to the tubing string in which the valve is connectable. U.S. Pat. No. 3,036,590 is incorporated by reference for all purposes within this application.

U.S. Pat. No. 3,743,015 discloses a mud saver valve which functions as a check valve to prevent reverse flow up the bore of the drill string. The mud saver valve is not manually operated between its open and closed positions. The mud saver valve can be manually locked open if desired.

U.S. Pat. No. 4,074,761 discloses a safety valve which can be stabbed or connected onto the open end of a drill string at the well surface. The safety valve is mechanically locked open during the stabbing process and is moved to its closed position by a spring and/or fluids flowing in the reverse direction through the drill string.

U.S. Pat. No. 3,273,588 to W. W. Dollison discloses an operating sleeve moving longitudinally within a housing to shift various types of valve closure means such as a ball member, a flapper, or a poppet between their open and closed positions, U.S. Pat. No. 3,273,588 is incorporated by reference for all purposes within this application.

SUMMARY OF THE INVENTION

The present invention discloses a valve comprising housing means; a longitudinal flow passage extending through the housing means; valve closure means, disposed within the housing means, having a first position allowing fluid flow through the longitudinal flow passage and a second position blocking fluid flow through the longitudinal flow passage; an operating sleeve means slidably disposed within the longitudinal flow passage and engaging the valve closure means to shift the valve closure means between its first and second positions; a first longitudinal slot formed in the housing means and communicating between the interior and the exterior of the housing means; a first pin means projecting through the first slot and engaging the operating sleeve means; the first pin means being slidable within the first slot and a portion of the first pin means extending exterior from the first slot; and means for engaging the first pin means with a shifting tool to move the first pin means and operating sleeve means longitudinally with respect to the housing means.

One object of the present invention is to provide a valve having a uniform outside diameter which can be manually opened or closed.

Another object of the present invention is to provide a valve having an operating sleeve, longitudinally movable within the valve housing, which can be engaged by a shifting tool from the exterior of the valve housing to open or close the valve.

A further object of the present invention is to disclose a valve which can be manually operated without regard to the vertical or horizontal orientation of the valve.

Still another object of the present invention is to disclose a manually operated safety valve for use in a drill string or workover string at or near the well surface. The present invention allows the safety valve to have a uniform outside diameter compatible with the drill string or workover string.

A still further object of the present invention is to provide a means for indicating when the valve closure means has been shifted full open or full closed.

These and other objects and advantages of the present invention will become apparent to those skilled in the art from the following drawings, written description and claims.

DESCRIPTION OF THE PREFERRED EMBODIMENTS

Figure 1:
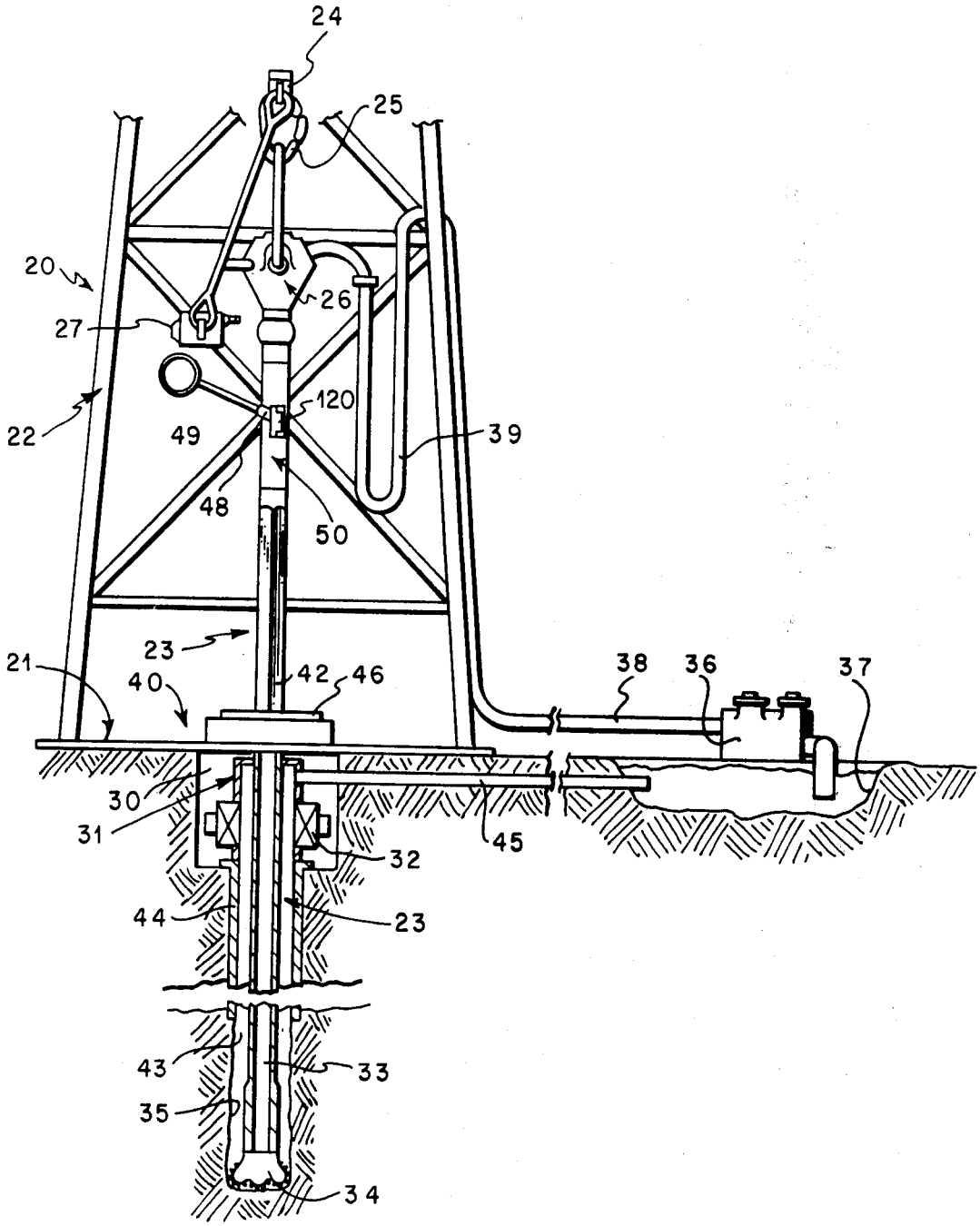
FIG. 1 is a schematic drawing, partially in section and partially in elevation, showing the safety valve of the present invention installed within a drill string.

Referring generally to the drawings and specifically to FIG. 1, a schematic representation of an oil or gas well 40 is shown being drilled by derrick 20. Typically, derrick 20 would be a steel structure built over a well site to provide support for drilling equipment including mast 22 and rig floor 21. Mast 22, partially shown, is a tall structure for raising and lowering drill string 23. Draw works (not shown), including power machinery, a hoisting drum, cable, shafts, clutches and brakes, would normally be located on one side of rig floor 21 to raise and lower drill string 23. Traveling block 24 with hook 25 is normally suspended from mast 22 by cables (not shown) connected to the draw works.

In FIG. 1, elevators 27 and mud swivel 26 are shown attached to hook 25. Elevators 27 include a heavy, hinged clamp used for raising or lowering drill pipe, casing and tubing. During rotation of drill string 23, elevators 27 are disengaged, as shown, and drill string 23 is connected to swivel 26.

Cellar 30 is excavated at the well site before erecting derrick 20 to provide working space for casing head equipment or assembly 31 and blowout preventer valves 32. In actual practice, several sizes of blowout preventers are stacked concentrically on top of each other at the well surface. A separate blowout preventer is normally provided to seal around the outside diameter of each size of drill pipe, tubing or casing planned for use in well 40. In addition, one or more blowout preventers are usually provided with blind rams or shear rams to cut the tubing and/or drill string to completely seal off well bore 35. U.S. Pat. No. 3,036,590 shows a typical blowout preventer. At some well sites, rig floor 21 may be raised several feet above the earth's surface to eliminate the need for excavating cellar 30.

While drilling new wells or working over previously completed wells, the pressure of formation fluids downhole is normally controlled by "mud." Drilling mud is a mixture of clay, water, and chemical additives which is pumped downhole though bore 33 of drill string 23 and out through holes (not shown) in drill bit 34. The mud cools rapidly rotating bit 34, lubricates drill string 23 as it turns within well bore 35, and carries cuttings to the well surface. Drilling mud provides a hydrostatic head to prevent formation fluids from entering well bore 35 thus controlling downhole pressures.

Mud pump 36 takes drilling mud from pit 37 and discharges it under pressure through piping 38 and mud hose 39 to swivel 26. Safety valve 50 of the present invention is shown installed between swivel 26 and kelly joint 42. As will be explained later, valve 50 contains a valve closure means which in its first position allows fluid flow therethrough. The drilling mud can flow down through valve 50, kelly joint 42, bore 33 of drill string 23 and out through holes (not shown) in drill bit 34. The drilling mud then flows back to the well surface through annulus 43 formed between the exterior of drill string 23 and well bore 35.

Casing 44 is installed within well bore 35 near the well surface to support blowout preventers 32 and casing head assembly 31. Casing head assembly 31 directs the drilling mud into pipe 45 for return to pit 37. One or more mud wiper assemblies (not shown) are usually installed within casing head assembly 31 to allow rotation and/or longitudinal movement of drill string 23 through casing head assembly 31 while blocking drilling mud from communicating with cellar 30 from around the exterior of drill string 23.

During drilling operations, rotary blade 46 engages the flat sides of kelly joint 42 to rotate drill string 23. As will later be explained, shifting tool 49 is used to open or close valve 50. Shifting tool 49 is not inserted into valve 50 while drill string 23 is rotating. Rotation of drill string 23 must be stopped before shifting tool 49 can be inserted into valve 50 as shown in FIG. 1.

For purposes of explanation, valve 50 is shown installed between swivel 26 and kelly joint 42. However, the present invention allows the outside diameter of valve 50 to be completely compatible with the outside diameter of the drill string or workover string in which it is installed. Therefore, valve 50 could be installed at any desired location above or below kelly joint 42.

Valve 50 is also shown in the vertical position for explanation only. The present invention allows valve 50 to be opened and closed without regard to its vertical or horizontal orientation. Also, as will be explained later, valve 50 can be opened and closed without regard to fluid pressure or fluid flow within valve 50.

Figure 2A:
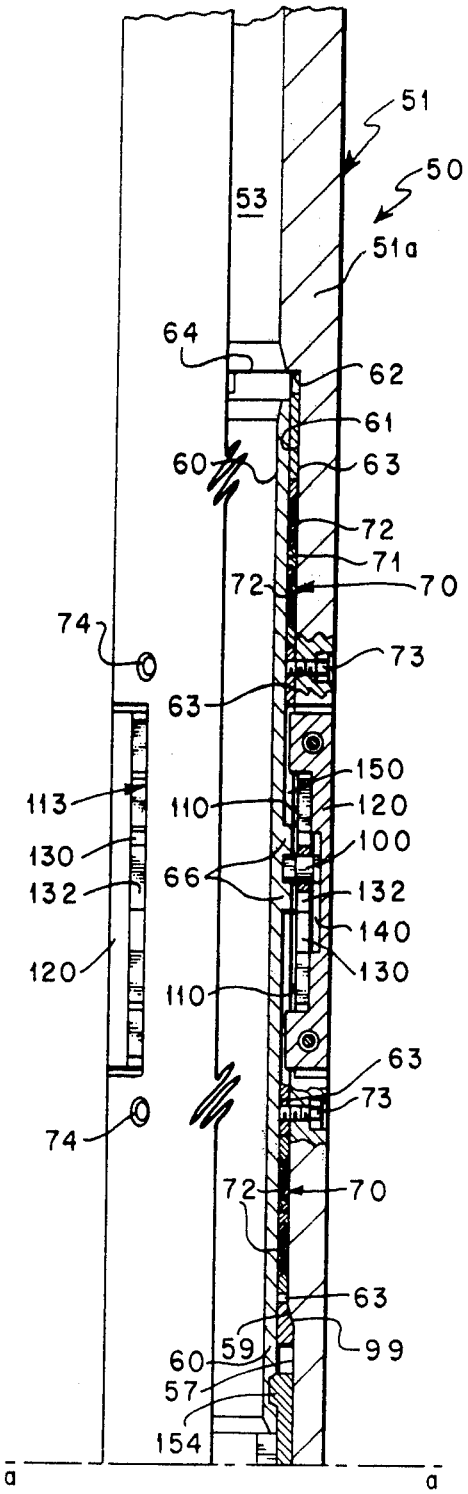
FIGS. 2A and B are drawings, partially in section and partially in elevation, showing the safety valve of the present invention with its valve closure means in the first position allowing fluid flow through the valve.
Figure 2B:
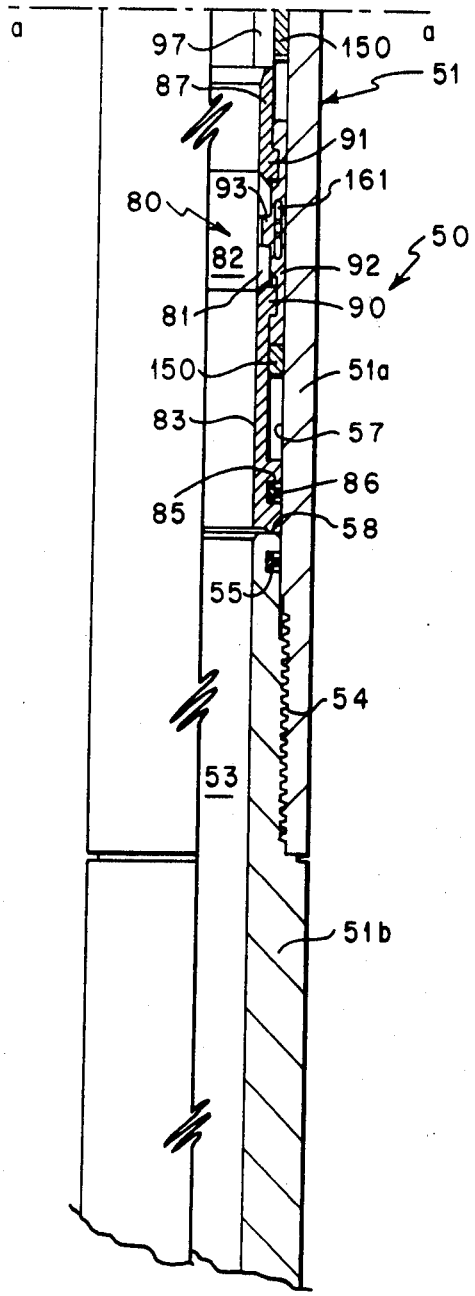
Figure 3C:
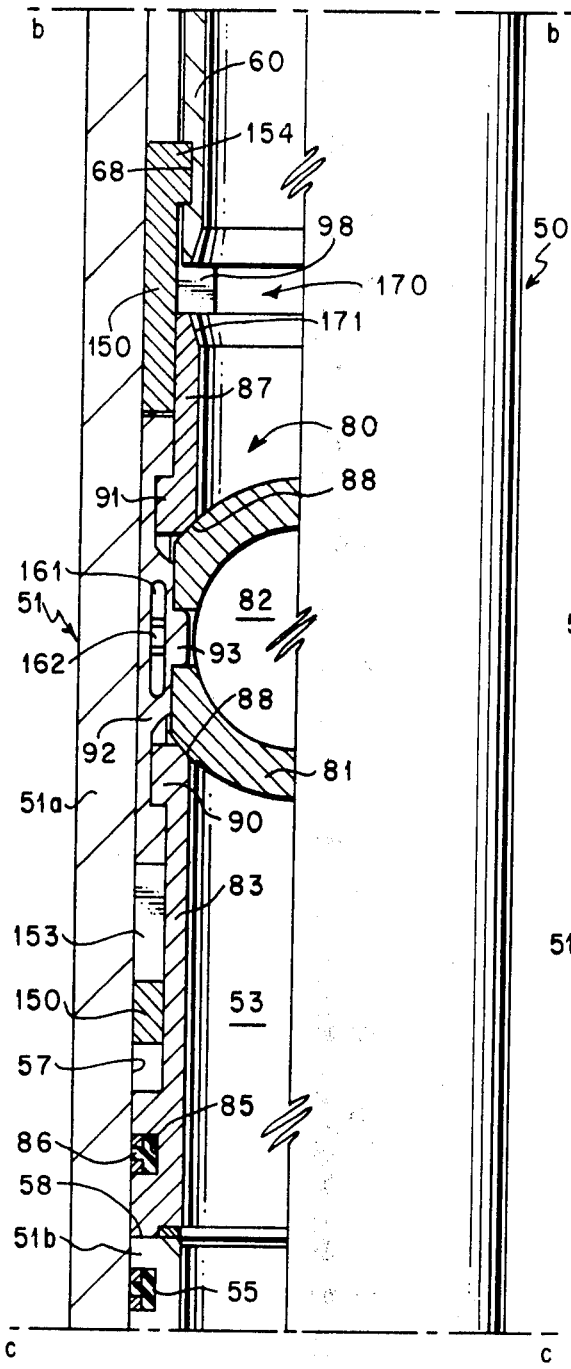
FIGS. 3A, B, C and D are enlarged drawings, partially in section and partially in elevation, showing the safety valve of the present invention with its valve closure means in the second position blocking fluid flow through the valve.
Figure 3D:
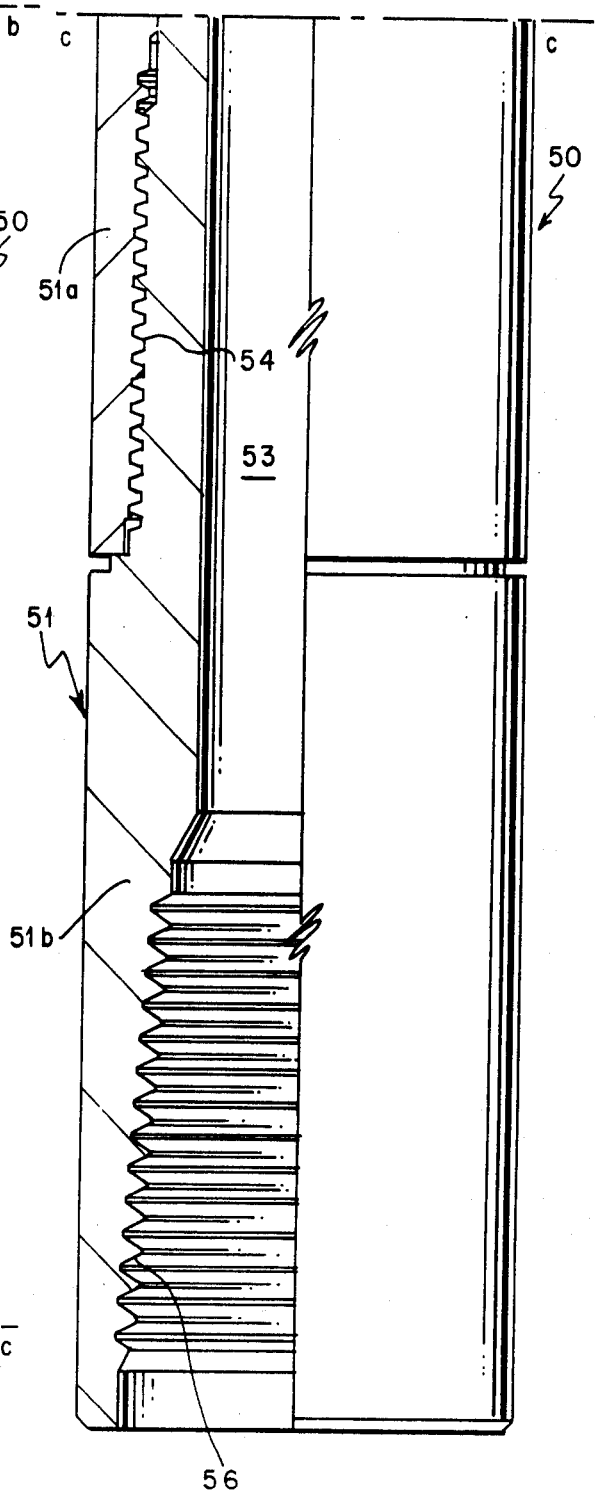
Figure 4:
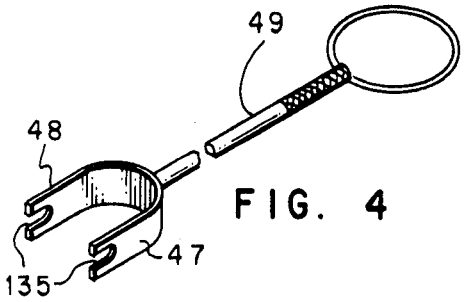
FIG. 4 is a drawing in elevation showing an orthographic projection of a shifting tool with a portion broken away.
Figure 5:
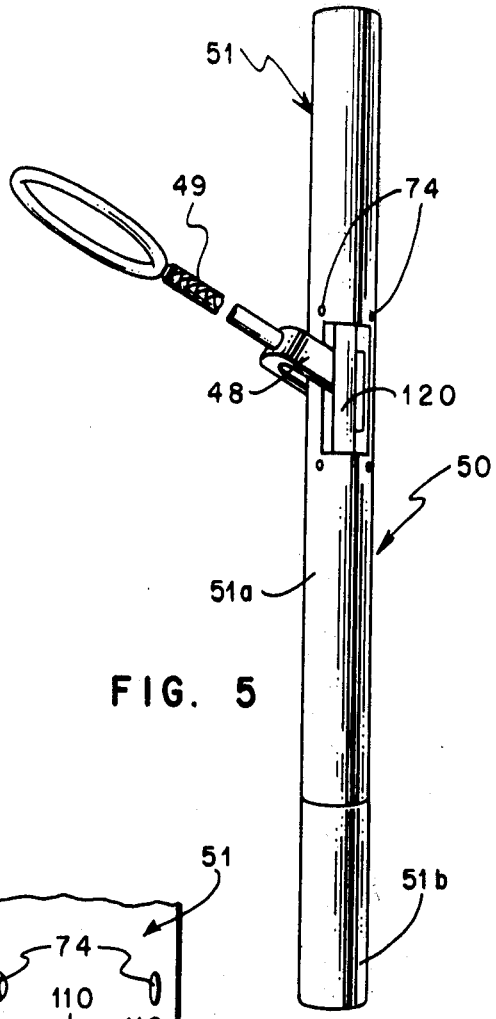
FIG. 5 is a schematic drawing in elevation showing the shifting tool inserted into openings in the housing means.

Referring generally to FIGS. 2A and 2B, safety valve 50 is shown with valve closure means 80 in its first position allowing fluid flow therethrough. Valve 50 comprises housing means 51 which is made from various subassemblies for ease of manufacture. Main housing subassembly 51*a* is connected to adapter housing subassembly 51*b* at threaded connection 54. Housing means subassemblies 51*a* and 51*b* are concentrically aligned with longitudinal flow passage 53 extending therethrough. Seal ring 55 forms a fluid tight barrier to prevent fluids from communicating through threaded connection 54. As best shown in FIGS. 3A and 3D, heavy duty threads 56 are formed in opposite ends of housing subassemblies 51*a* and 51*b* within longitudinal flow passage 53 to provide a means for attaching each end of housing means 51 to a flow conductor such as drill string 23.

The inside diameter of longitudinal flow passage 53 is selected to be generally compatible with the inside diameter of bore 33. A portion of longitudinal flow passage 53 has an enlarged inside diameter 61 forming shoulder 62 within housing subassembly 51*a*. Operating sleeve means 60, which has a reduced outside diameter as compared to inside diameter 61, is slidably disposed within this portion of longitudinal flow passage 53. Inside diameter portion 61 of longitudinal flow passage 53 extends within housing subassembly 51*a* from shoulder 62 to tapered shoulder 59. The inside diameter of longitudinal flow passage 53 gradually expands from inside diameter 61 to larger inside diameter 57 at tapered shoulder 59. The overall length of operating sleeve means 60 is longer than the length of inside diameter portion 61 between shoulder 62 and tapered shoulder 59. Thus, one end of operating sleeve means 60 extends into inside diameter portion 57 of longitudinal flow passage 53.

Figure 16:
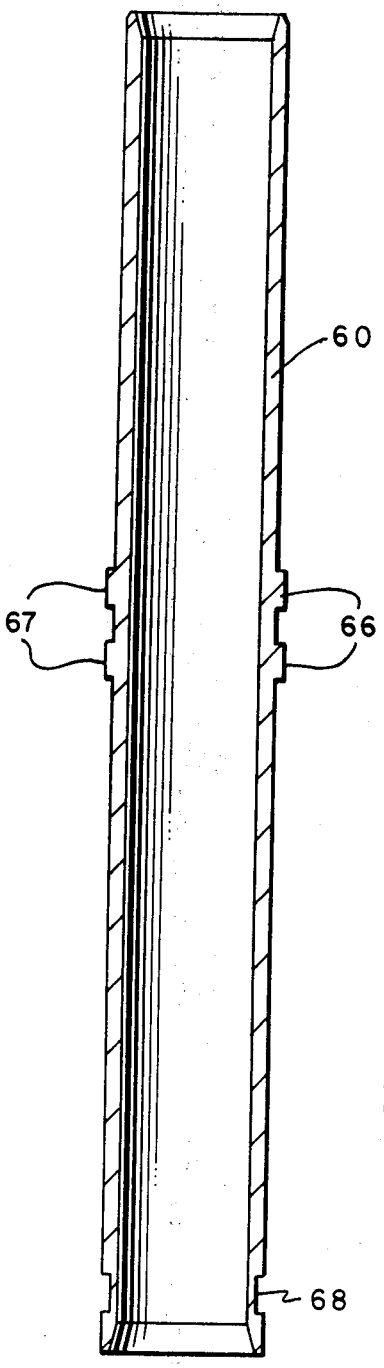
FIG. 16 is a drawing, in section, of the operating sleeve used to shift the valve closure means between its first and second positions.
Figure 17:
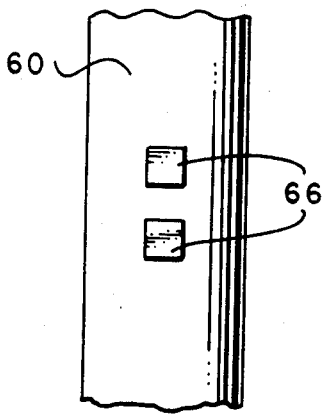
FIG. 17 is a partial drawing, in elevation of the operating sleeve, showing the means for engaging the operating sleeve with the first pin means.

As best shown in FIGS. 16 and 17, the outside diameter of operating sleeve means 60 is essentially uniform except for two sets of bosses 66 and 67 disposed radially opposite each other and recess or groove 68. Bosses 66 project radially outward from the exterior of operating sleeve means 60. Bosses 67 project radially outward from the exterior of operating sleeve means 60 opposite from bosses 66. Recess 68 is formed in the exterior of operating sleeve means 60 near the end extending into inside diameter portion 57. Preferably, the exterior of operating sleeve means 60 has a smooth surface suitable for forming a fluid tight barrier with elastomeric material.

Fluid flow between the exterior of operating sleeve means 60 and inside diameter 61 is prevented by sets of packing or sealing means 70. Sets of packing means 70 are disposed around the exterior of operating sleeve means 60 longitudinally spaced from bosses 66 and 67 in both directions. Packing means 70 are shown as a series of metal backup rings 71 and chevron packing rings 72. Various other packing or sealing means could be selected as long as fluid communication between the exterior of operating sleeve means 60 and inside diameter 61 is blocked while still permitting operating sleeve means 60 to slide longitudinally relative to housing means 51.

A plurality of cylinders 63 is also disposed between the exterior of operating sleeve means 60 and inside diameter 61 of housing means 51. Cylinder 63*a* abuts shoulder 62 and one set of packing means 70. The remaining cylinders 63 are located adjacent to and abut the sets of packing means 70. Cylinders 63 function as spacers to ensure the proper location of packing means 70 relative to housing means 51 and operating sleeve means 60. A plurality of bolts 73 extends through boltholes 74 to engage cylinders 63 to prevent longitudinal movement of cylinders 63 and packing means 70 relative to housing means 51.

For ease of manufacture and assembly, boltholes 74 are spaced radially and longitudinally about the exterior of housing means 51. Bolts 73 extend through boltholes 74 and anchor cylinders 63 relative to housing means 51. The specific location of boltholes 74 and the engagement between bolts 73 and cylinders 63 does not correspond with the section views chosen for FIGS. 2A, 3A, and 3B. Therefore, boltholes 74, bolts 73, and cylinders 63 are shown as broken portions in these sectional drawings.

Figure 14:
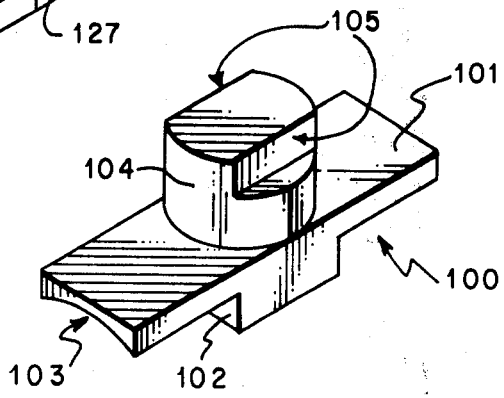
FIG. 14 is an enlarged, orthographic projection in elevation of the first pin means.
Figure 15:
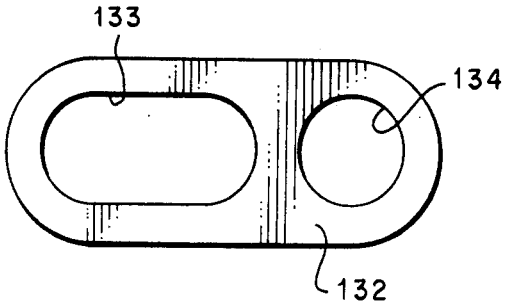
FIG. 15 is an enlarged, plan view of a link sized for engagement with the first pin means and the shifting tool.

Bosses 66 and 67 provide part of the means for shifting tool 49 to move operating sleeve means 70 longitudinally relative to housing means 51. Preferably, one set or pair of bosses 66 is located on one side of operating sleeve means 60 and another set of bosses 67 is located radially opposite therefrom. One first pin means or operating pin 100, shown in FIG. 14, is designed to be secured by each set of bosses 66 and 67 to operating sleeve means 60. Operating sleeve means 60 could be moved longitudinally by only one first pin means 100 and only one set of bosses 66 if desired. However, engagement of operating sleeve means 60 by two first pin means 100 spaced radially opposite from each other provides a more rugged and reliable safety valve 50.

First pin means or operating pin 100 comprises a rectangular plate 101 with a square post 102 projecting inwardly. Plate 101 is sized to cover the ends of both bosses 66 with square post 102 therebetween. Inner surface 103 of plate 101 is slightly curved to allow plate 101 to rest more securely on the ends of bosses 66. Round pin 104 projects from the side of plate 101 opposite post 102. Two flat surfaces 105 are cut into the end of round pin 104 on opposite sides thereof and parallel with the longest sides of plate 101. The above description has been made with reference to bosses 66. Bosses 67 and the respective first pin means 100 engaged therewith are identical.

First longitudinal slots 110 are formed in housing means subassembly 51*a* spaced radially opposite from each other. First longitudinal slots 110 communicate between inside diameter 61 and the exterior of housing means 51. Each longitudinal slot 110 is sized to allow round pin 104 of first pin means 100 to slide therein. The length of round pin 104 is selected such that first pin means 100 projects through first slots 110 when square post 102 is engaged with operating sleeve means 60. Preferably, safety valve 50 has two first longitudinal slots 110 with one first pin means 100 slidably disposed in each. The length of each first longitudinal slot 110 is selected to be longer than the maximum length of travel of operating sleeve means 60.

Figure 6:
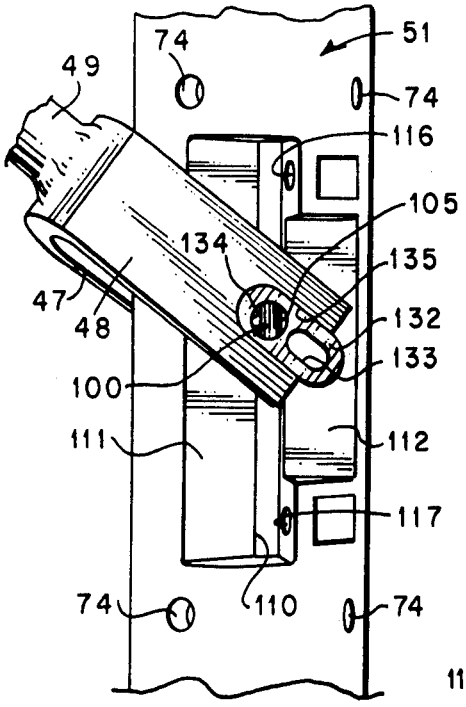
FIG. 6 is a schematic drawing, partially in elevation with portions of the valve and housing means broken away, showing the shifting tool engaging the first pin means and link when the valve closure means is in its first position.
Figure 7:
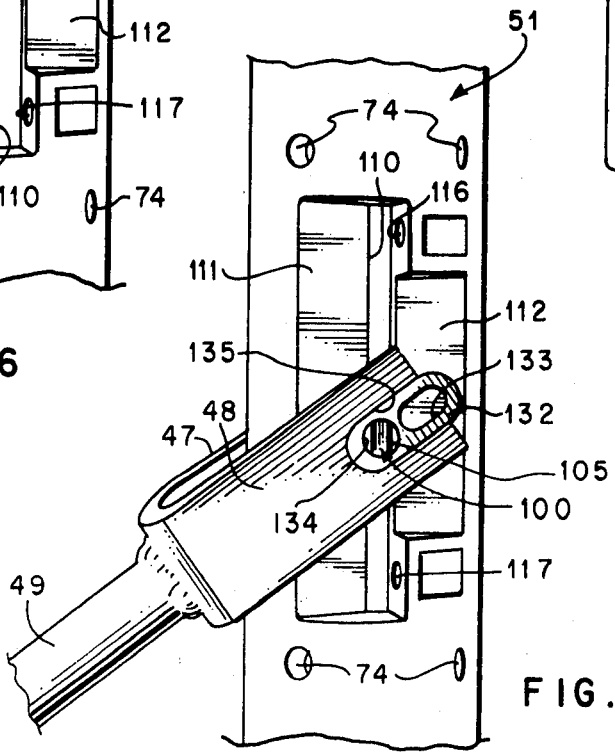
FIG. 7 is a schematic drawing in elevation similar to FIG. 6 showing the engagement between the shifting tool and the first pin means after the valve closure means has been moved to its second position.
Figure 8:
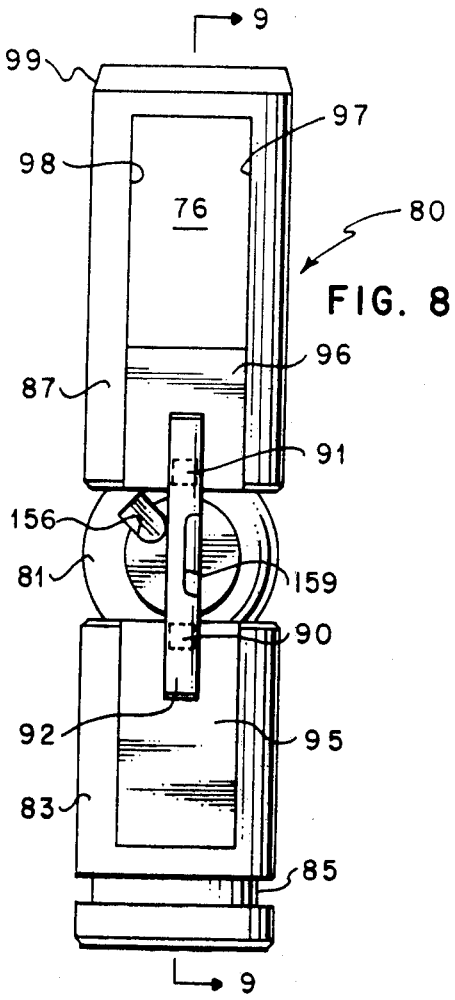
FIG. 8 is a drawing in elevation of the valve closure means used with the present invention.
Figure 9:
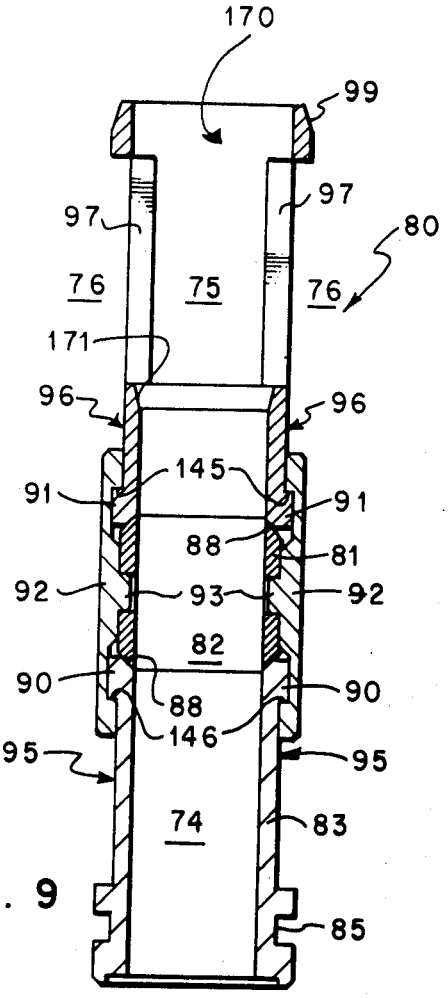
FIG. 9 is a drawing in section along lines 9—9 of FIG. 8.
Figure 10:
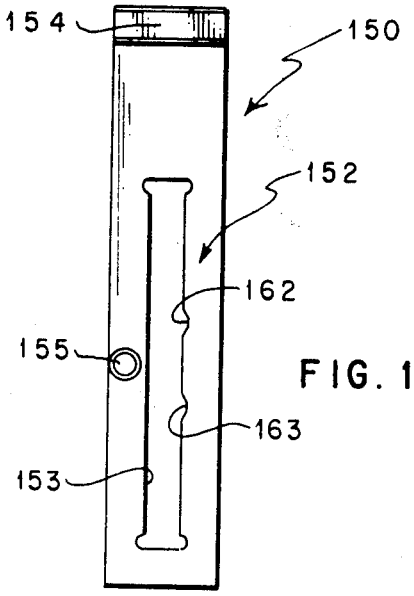
FIG. 10 is an enlarged drawing in elevation showing the inner surface of one of the operating arms used to connect the operating sleeve to the valve closure means.
Figure 11:
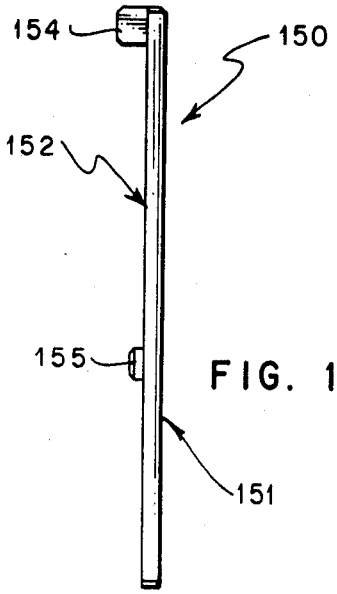
FIG. 11 is a side view of the operating arm in FIG. 10 showing a rotating pin projecting inwardly from its inner surface.
Figure 12:
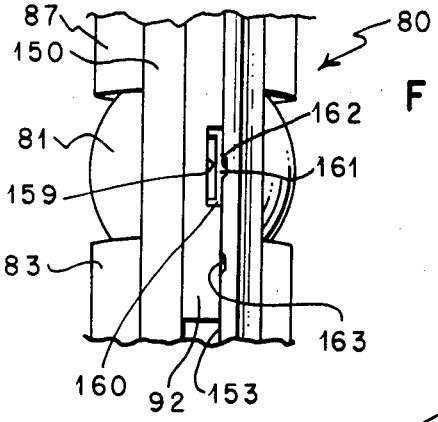
FIG. 12 is a schematic drawing, in elevation of the valve closure means with portions broken away, showing a detent spring carried in a pivot arm and engaged with one of the operating arms.

As previously noted, sets of packing means 70 are disposed around operating sleeve means 60 and spaced longitudinally in both directions from bosses 66 and 67. Packing means 70 and cylinders 63 are also located to provide a means for sealing between the outside diameter of operating sleeve 60 and inside diameter 61 of housing means 51 to block fluid communication between longitudinal flow passage 53 and the exterior of housing means 51 through longitudinal slots 110. Housing means 51 has a generally cylindrical exterior. Portions of the exterior of housing means 51 are removed to form planar surfaces adjacent to both sides of each first longitudinal slot 110. Planar surfaces 111 and 112 are shown in FIGS. 6 and 7. Preferably, identical planar surfaces 113 and 114 are provided on the opposite side of housing means 51. Surface 114 is not shown. Surface 111 and 112 are parallel. The spacing between forks 47 and 48 on the end of shifting tool 49 is selected to be slightly larger than the thickness of valve 50 between surfaces 111 and 113.

Surface 112 is reduced in area as compared to surface 111. Surfaces 114 and 113 have the same relationship. Thus, portions of, the exterior of housing means 51 are available at either end of surface 112 to provide screwholes 116 and 117. Housing means 51 also comprise two covers 120. Each cover 120 is formed from a segment of a cylinder having a radius matching the exterior of housing means 51. One cover 120 is provided to go over each first longitudinal slot 110 and its adjacent planar surfaces.

Figure 13:
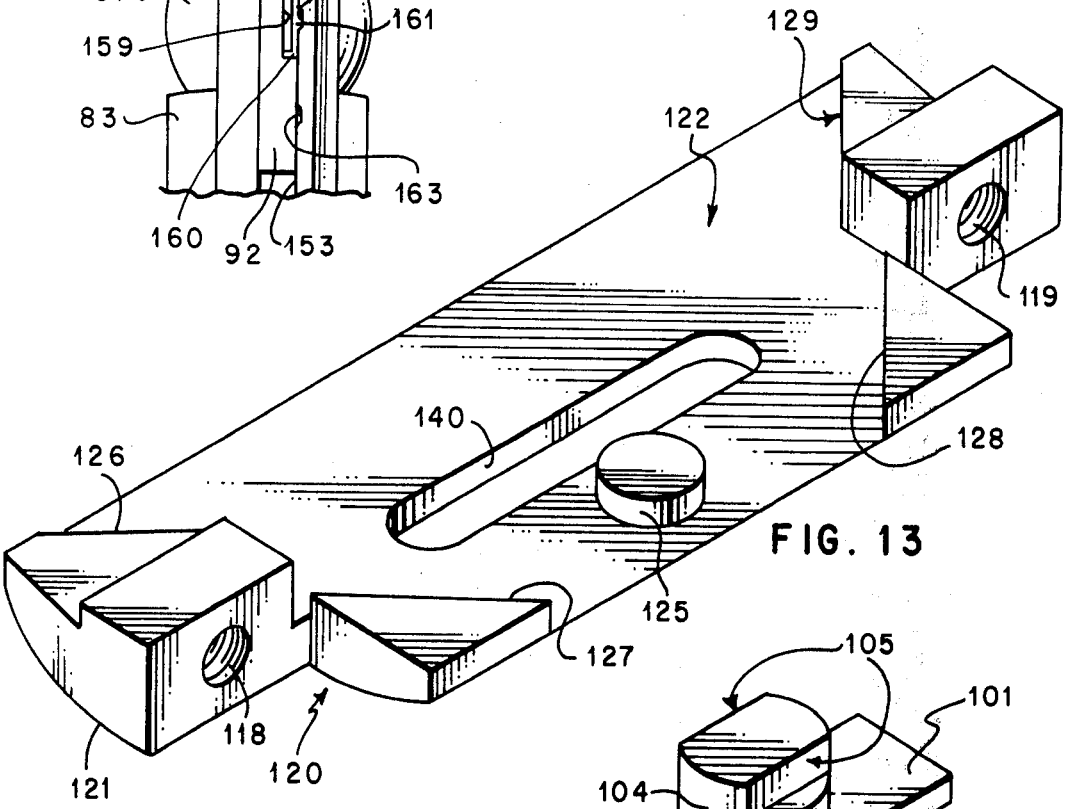
FIG. 13 is an enlarged, orthographic projection showing the interior of one of the covers which comprises part of the housing means.

Interior 122 of cover 120 is generally a flat surface with various, attached projections facing inwardly towards the respective planar surfaces. Screwholes 118 and 119 are provided in two of these projections. Referring specifically to FIGS. 7 and 13, cover 120 is designed to be fitted over longitudinal slot 110. Screwhole 118 can be aligned with screwhole 116 and screwhole 119 with screwhole 117. Appropriate bolts or screws are then inserted into the aligned screwholes to provide a means for attaching cover 120 to housing means 51 over planar surfaces 111 and 112. An identical cover 120 is attached to housing means 51 over planar surfaces 113 and 114 and its adjacent first longitudinal slot 110.

Exterior 121 of cover 120 is generally curved having a radius matching the outside diameter of housing means 51. When both covers 120 are installed, valve 50 is provided with a uniform outside diameter. Therefore, valve 50 can be raised or lowered through restricted openings such as a blowout preventer or casing head wipers without damaging elastomeric material carried within the restricted openings.

A second pin means or pivot post 125 is attached to interior 122 of each cover 120 and projects inwardly towards the respective planar surface of housing means 51. Additional projections 126, 127, 128 and 129 are provided around the periphery of interior 122 to rest upon the respective planar surfaces when cover 120 is attached to housing means 51. Projections 126, 127, 128 and 129 prevent interior 122 from directly contacting the planar surface adjacent to each cover 120 and create an opening 130 between each cover 120 and the respective planar surface 111 or 113. The height of each projection 126, 127, 128 and 129 is selected to be slightly larger than the thickness of forks 47 and 48 on shifting tool 49. Thus, valve 50 has two openings 130 into housing means 51 which are sized to accommodate shifting tool 49 and allow insertion of forks 47 and 48.

When each cover 120 is attached to housing means 51, second pin means or pivot post 125 is secured adjacent to and offset from each respective first longitudinal slot 110. As previously noted, a portion of each first pin means 100 including round pin 104 with flat surfaces 105 is sized to extend exterior from its respective first slot 110 when first pin means 100 is engaged with operating sleeve 60. Links 132 are carried by housing means 51 exterior to each first longitudinal slot 110. Links 132 comprise part of the means for engaging each first pin means 100 with shifting tool 49 to move first pin means 100 and operating sleeve means 60 longitudinally with respect to housing means 51. Oval shaped opening 133 is cut from each link 132 near one end thereof. Circular opening 134 is cut from each link 132 near the other end thereof. The one end of link 132 is rotatably attached to housing means 51 by placing second pin means 125 within oval 133. Second pin means 125 could be machined directly onto the respective planar surface adjacent to first longitudinal slot 110 if desired. For ease of assembly, second pin means 125 is attached to cover 120. Circular opening 134 is slightly larger than the outside diameter of round pin 104 to allow the other end of link 132 to engage first pin means 100. Oval 133 allows link 132 to rotate and translate longitudinally with respect to second pin means 125 as operating sleeve means 60 moves longitudinally within longitudinal flow passage 53.

The exterior of each link 132 is generally oval shaped and sized to be engaged by matching openings 135 in the end of forks 47 and 48 on shifting tool 49. The engagement between first pin means 100, shifting tool 49, and link 132 is best shown in FIGS. 6 and 7. Second pin means 125 is not shown within oval 133 because cover 120 on the side of housing means 51 shown in these Figures has been removed. Fork 47 engages an identical link 132 and first pin means 100 on the opposite side of valve 50. The thickness of each link 132 is selected to allow link 132 to slide between interior 122 of cover 120 and its respective planar surfaces.

For increased reliability and sturdiness, a third longitudinal slot 140 is formed partially through interior 122 of each cover 120. When each cover 120 is secured over its respective first longitudinal slot 110, third longitudinal slot 140 is aligned longitudinally therewith. The width of third longitudinal slot 140 is selected to allow flat surfaces 105 of first pin means 100 to slide therein.

As previously noted, cylinders 63 are disposed around the exterior of operating sleeve means 60 and inside diameter 61 to secure sets of packing means 70 opposite each end of each first longitudinal slot 110. If desired, a continuous cylinder 63 could extend between the sets of packing means 70 at opposite ends of longitudinal slots 110. In this case, a second longitudinal slot 150 would be cut through the wall of cylinder 63 adjacent to and aligned with each first longitudinal slot 110 in housing means 51. Preferably, square post 102 of each first pin means 100 is secured between sets of bosses 66 and 67. Round pin 104 projects through its respective first slot 110 and second longitudinal slot 150. Flat surfaces 105 are slidably disposed within its respective third longitudinal slot 140. Other configurations of first pin means 100 are possible including merely a rod pin attached to operating sleeve 60 and projecting through one longitudinal slot in housing means 51. However, the above described arrangement provides improved reliability and strength for shifting tool 49 to move operating sleeve means 60 longitudinally.

As previously noted, valve closure means 80 is disposed within housing means 51. In FIG. 2B, valve closure means 80 is shown in its first position allowing fluid flow through longitudinal flow passage 53. In FIG. 3C, valve closure means 80 is shown in its second position blocking fluid flow through longitudinal flow passage 53. Valve closure means 80 comprises ball member 81 which has bore 82 therethrough. Bore 82 is aligned parallel with and concentric to longitudinal flow passage 53 when valve closure means 80 is in its first position. Bore 82 is rotated normal to longitudinal flow passage 53 when valve closure means 80 is in its second position.

Support ring or seat means 83 is secured within longitudinal flow passage 53 on one side of ball member 81 and has one end resting upon shoulder 58 formed by the end of housing subassembly 51*b* within housing subassembly 51*a*. Groove or recess 85 is formed in the outside diameter of support ring 83 near the one end thereof. Seal ring 86 similar to seal ring 55 is carried within recess 85. Seal ring 86 forms a fluid tight barrier with inside diameter 57 of housing means 51 adjacent to support ring 83. Seal ring 86 prevents fluid within longitudinal flow passage 53 from bypassing ball member 81 by flowing between the outside diameter of support ring 83 and inside diameter 57 of housing means 51.

Support ring or seat means 87 is secured within longitudinal flow passage 53 on the side of ball member 81 opposite from support ring 83. Sealing surfaces 88 are formed on the end of each support ring 83 and 87 which contacts the exterior of ball member 81. Sealing surfaces 88 block fluid flow between the ends of support rings or seat means 83 and 87 and the exterior of ball member 81.

Support rings 83 and 87 are generally cylindrical. Portions of the exterior of the support ring 83 are removed to form two flat surfaces 95, each diametrically opposed, on the exterior of support ring 83. Bosses or square posts 90 are formed near the end of support ring 83 having sealing surface 88 as part of each surface 95. Also, a pair of flat surfaces 96 are formed on opposite sides of support ring 87 by removing a portion of the exterior thereof. Bosses or square posts 91 are formed near the end of support ring 87 having sealing surface 88 as part of each surface 96. Portions of support ring 87 are completely cut away to form large rectangular openings 76 extending longitudinally from each flat surface 96.

Support rings 83 and 87 are generally cylindrical with longitudinal bores 74 and 75 respectively therethrough. Openings 76 in support ring 87 are spaced radially opposite from each other and allow unrestricted communication with bore 75. Inside diameter 170 of the portion of bore 75 having openings 76 is uniform throughout. The end of operating sleeve means 60 having recess 68 is slidably disposed within this portion of bore 75. Inside diameter 171 of bore 75 below openings 76 is tapered to minimize turbulence of fluid flowing through bore 82 of ball member 81.

The other end of support ring 87 opposite the end contacting ball member 81 has a tapered outside diameter 99. Taper 99 is sized to be larger than inside diameter 61 of housing means subassembly 51*a* and to contact tapered shoulder 59. Thus, valve closure means 80 is secured within housing means 51 by taper 99 engaging the transition of longitudinal flow passage 53 from inside diameter 57 to inside diameter 61 and the end of support ring 83 abutting shoulder 58.

A pair of pivot arms 92 extend between each support ring 83 and 87 and secure ball member 81 therebetween. Each pivot arm 92 has inside shoulder 146 to engage its respective boss 90 and shoulder 145 to engage its respective boss 91. Pivot pins 93 extend inwardly from each pivot arm 92 and engage ball member 81 normal to bore 82. The length of pivot arms 92 and the diameter of ball member 81 is selected to allow ball member 81 to rotate about pivot pins 93 between support rings 83 and 87. Pivot arms 92 prevent any significant longitudinal movement of support rings 83 and 87 and ball member 81 relative to each other. Thus, ball member 81 is rotatably secured within longitudinal flow passage 53 and restrained from moving longitudinally therein.

Operating sleeve means 60 engages valve closure means 80 to shift valve closure means 80 between its first and second positions. A pair of operating arms 150 are preferably secured within recess 68 of operating sleeve means 60. Each arm 150 projects through and sides within one of opening 76 of support ring 87. Inner surfaces 97 and 98 of openings 76 act as guides for operating arms 150.

Operating arms 150 are formed from a segment of a cylinder and have a curved exterior 151. Interior 152 of each operating arm 150 is a flat surface with window 153 cut therethrough. Window 153 is sized to allow pivot arm 92 to fit therein and for operating arm 150 to slide around the exterior of pivot arm 92. The width of flat surfaces 95 and 96 is slightly larger than the width of its respective operating arm 150 so that each operating arm 150 is slidable along the exterior of each support ring 83 and 87. Flange 154 projects inwardly from surface 152 and fits within recess 68.

Each operating arm 150 has a rotating pin 155 which projects inwardly from surface 152. Ball member 81 has recesses 156 formed in its exterior offset from the engagement with pivot pins 93. Recess 156 is sized to receive its respective rotating pin 155 whereby longitudinal movement of operating sleeve means 60 and attached operating arms 150 will rotate ball member 81 about pivot pins 93. Rotating ball member 81 ninety degrees shifts valve closure means 80 between its first and second positions.

Each pivot arm 92 has a recess 159 formed in its exterior intermediate the ends thereof. Each recess 159 is sized to carry detent spring 160. Each detent spring 160 has a boss 161 projecting from its respective recess 159. Detent spring 160 and boss 161 are sized to allow boss 161 to contact the inside of window 153 of operating arm 150. Notch 162 is formed on the inside of each window 153 to correspond to the first position of valve closure means 80. Notch 163 is formed on the inside of each window 153 to correspond to the second position of valve closure means 80. Notches 162 and 163 are sized to receive boss 161. Detent spring 160 by boss 161 engaging notch 162 or notch 163 indicates when valve closure means 80 has completed movement between its first and second positions.

Operating Sequence

Safety valve 50 with valve closure means 80 in its first position is attached to a flow conductor such as drill string 23 by heavy duty threads 56 at each end of housing means 51. The inside diameter of operating sleeve 60 is essentially uniform throughout its length. Also, the outside diameter of operating sleeve 60 is essentially uniform throughout its full length except for bosses 66 and 67. Packing means 70 forms fluid tight seals on exterior portions of operating sleeve means 60 having uniform outside diameters. Therefore, the pressure of fluid within and flowing through longitudinal flow passage 53 is essentially balanced at each end of operating sleeve means 60 and does not tend to move operating sleeve means 60 longitudinally in either direction. Since the outside diameter of housing means 51 is compatible with the outside diameter of drill string 23, valve 50 can remain installed within drill string 23 while being raised, lowered or rotated.

When it is desired to shift valve closure means 80 from its first position to its second position, forks 47 and 48 of shifting tool 49 are inserted into openings 130 in the exterior of housing means 51 adjacent to each longitudinal slot 110. A portion of each first pin means or operating pins 100 extends from its respective longitudinal slots 110. Forks 47 and 48 engage each respective link 132 and attached first pin means 100. Pivot posts 125 allow each link 132, attached thereto, only limited longitudinal movement relative to housing means 51. Therefore, when the end of shifting tool 49 is moved longitudinally relative to housing means 51, links 132 rotate about their respective pivot posts 125. Each first pin means 100, secured within its respective longitudinal slots 110, 150, and 140, is moved longitudinally relative to housing means 51 by rotation of link 132. Since first pin means 100 are secured to opposite sides of operating sleeve means 60, operating sleeve means 60 also moves longitudinally relative to housing means 51 as links 132 are rotated.

As previously noted, ball member 81 is restricted from longitudinal movement relative to valve closure means 80, and valve closure means 80 is in turn restricted from longitudinal movement within longitudinal passage 53. Thus, longitudinal movement of operating sleeve means 60 moves operating arms 150 relative to pivot arms 92. Rotating pins 155 on operating arms 150 translate longitudinal movement of operating sleeve means 60 into rotation of ball member 81 about pivot pins 93.

Detent springs 160 are engaged with notches 162 when valve closure means 80 is in its first position. Detent springs 160 will engage notch 163 when valve closure means 80 has been shifted to its second position.

In order to shift valve closure means 80 from its second position to its first position, shifting tool 49 is inserted into housing means 51 and moved longitudinally in the opposite direction relative to housing means 51 to rotate links 132 in the opposite direction.

Alternative Embodiment

Figure 18A:
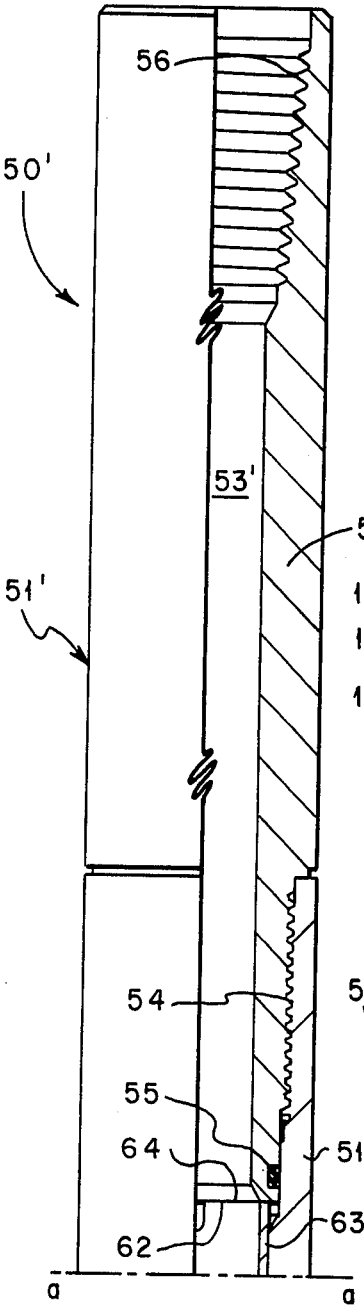
FIGS. 18A, B and C are drawings partially in section and partially in elevation, showing an alternative embodiment of the present invention with its valve closure means in the first position allowing fluid flow therethrough.
Figure 18B:
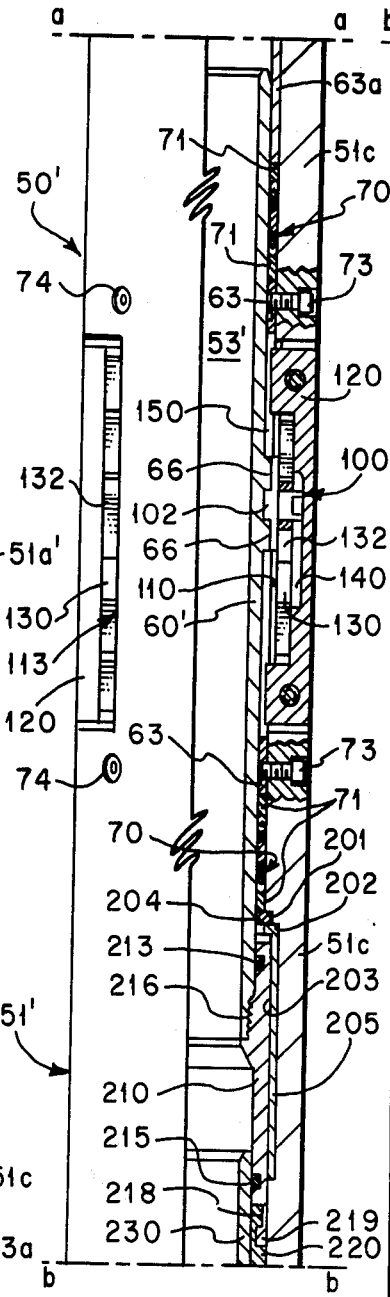
Figure 18C:
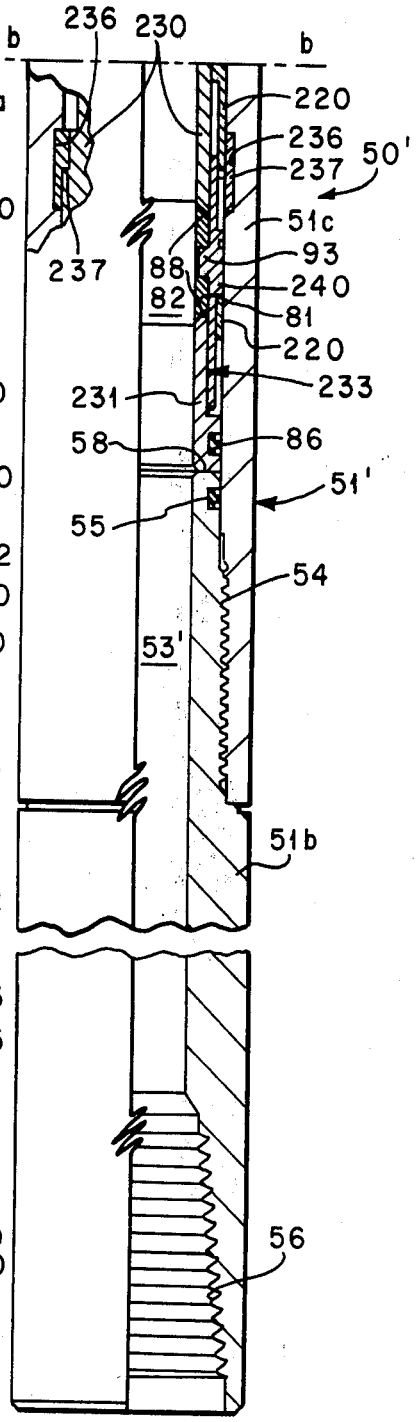
Figure 19:
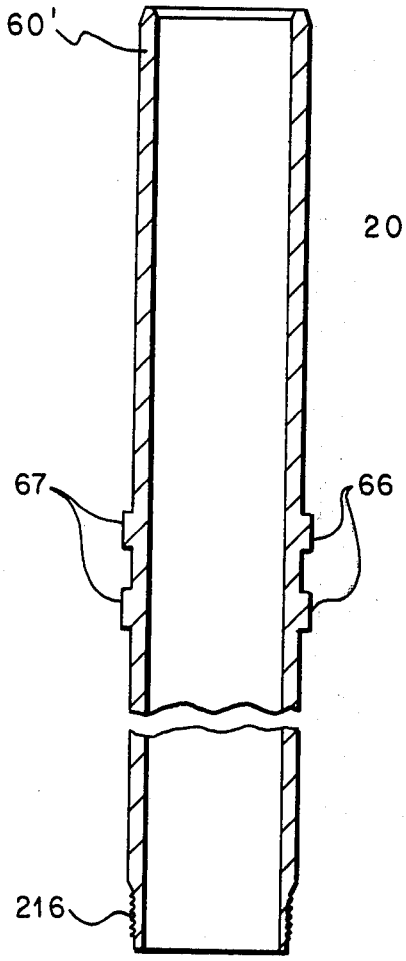
FIG. 19 is a drawing, in section, of the operating sleeve used in the alternative embodiment of FIGS. 18A–C to shift the valve closure means between its first and second positions.
Figure 20:
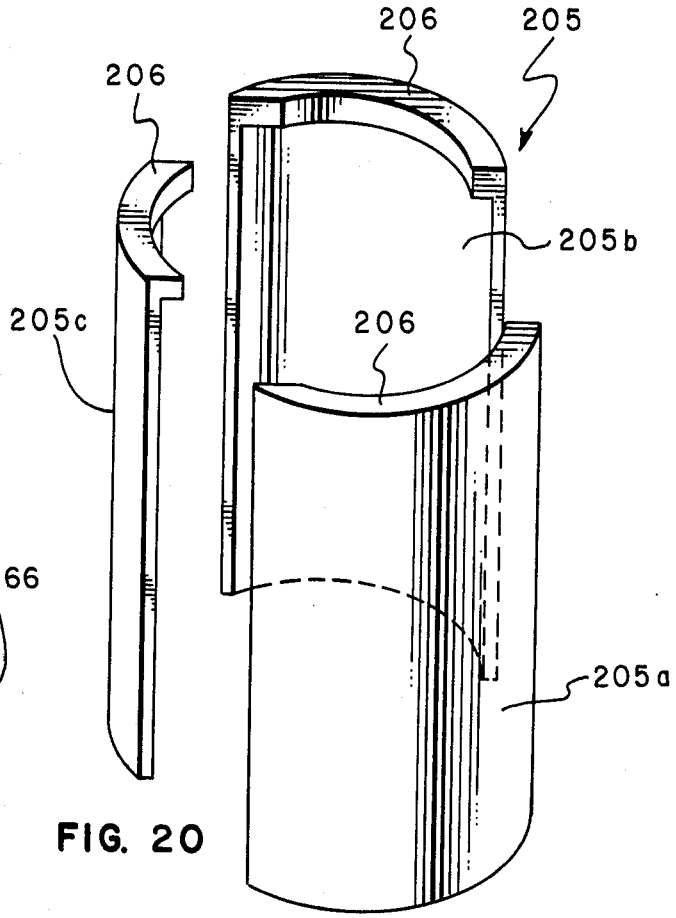
FIG. 20 is an isometric drawing of a split retaining cylinder used to position packing means 70 on the exterior of the operating sleeve.

FIGS. 18 A–C disclose an alternative embodiment of the present invention designated as safety valve 50'. Various components are interchangeable with previously described safety valve 50 and have the same numerical designation. Other components which are functionally equivalent but have a slightly modified design have the same numerical designation followed by '. Safety valve 50' has been modified to reduce the amount of force which must be applied by shifting tool 49 to move operating sleeve 60' longitudinally within housing means 51'. Also, the sealing system of valve closure means 200 has been modified to allow ball 81 to better resist high differential fluid pressure from either direction within longitudinal flow passage 53'.

Safety valve 50' includes housing means 51' which is made from various subassemblies for ease of manufacture. Subassembly **51*b* is the same in both housing means 51 and 51'. Within housing means 51', previously described subassembly 51*a* has been replaced by subassemblies 51*a'* and 51*c*. Heavy duty threads 56 are formed within one end of subassembly 51*a'* to provide a means for attaching housing means 51' to a flow conductor. Threaded connections 54 and seal rings 55 are used to connect subassemblies 51*a'*, 51*c* and 51*b*** to each other.

Flow passage 53' extends longitudinally through housing means 51'. The main difference between flow passage 53 and 53' is the replacement of tapered shoulder 59 of flow passage 53 by square shoulders 201 and 202 and recess 203 in flow passage 53'. Operating sleeve means 60' is slidably disposed within flow passage 53'. One set of packing means 70 is positioned between the outside diameter of housing means 51' by cylinder **63*a* and cylinder 63. Another set of packing means 70 is positioned between the lowest cylinder 63 and spacer ring 204. Split retaining cylinder 205 is disposed within recess 203 to properly position spacer ring 204 and its associated packing means 70 relative to operating sleeve means 60'. For ease of assembly, split retaining cylinder 205 consists of three separate segments 205*a*, 205*b* and 205*c*. Inwardly projecting rim 206 is formed at the top of each segment 205*a*, *b* and *c* to provide a rest or stop for spacer ring 204**.

Coupling 210 is used to transmit longitudinal movement of operating sleeve 60' to valve closure means 200. Coupling 210 is basically a cylinder with a longitudinal bore 211 therethrough. Bore 211 defines a portion of flow passage 53'. The outside diameter of coupling 210 is larger than the outside diameter of operating sleeve 60' which dictates the need for recess 203 and split retaining cylinder 205. Groove 212 is formed on the inside diameter of bore 211 near one end of coupling 210 to receive seal ring 213 therein. A similar groove 214 is formed on the inside diameter of bore 211 near the other end of coupling 210 to receive seal ring 215 therein. Seal ring 213 forms a fluid barrier with the exterior of operating sleeve 60', and seal ring 215 forms a similar fluid barrier with the exterior of valve closure means 200. The effective area of seal rings 213 and 215 is selected to be equal to the effective area of packing means 70. Providing equal seal areas minimizes fluid pressure forces which might restrict longitudinal movement of operating sleeve 60'.

Matching threads 216 are formed on both the exterior of operating sleeve 60' near one end and the inside diameter of bore 211. Threads 216 are used to attach coupling 210 to operating sleeve 60'. The extreme end of operating sleeve 60' abuts shoulder 217, formed on the inside diameter of bore 211, when threads 216 are engaged.

Figure 21:
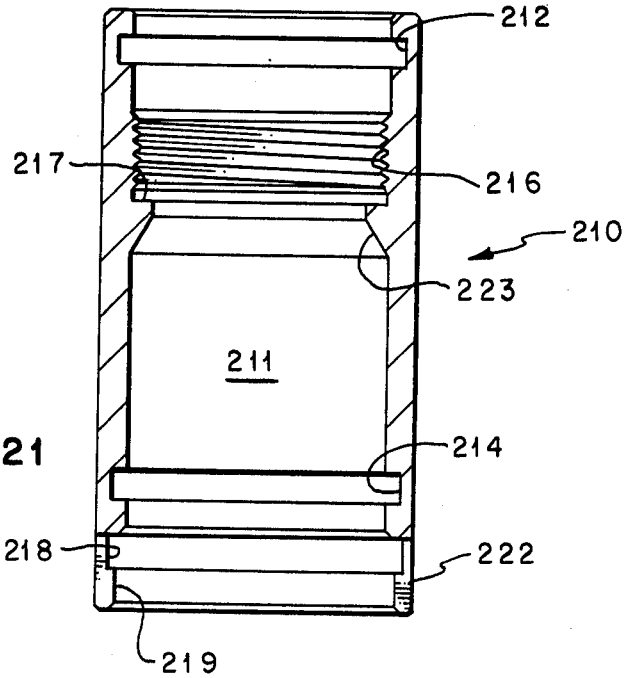
FIG. 21 is a drawing, in section, of the connector used to join the operating sleeve of FIG. 19 with the valve closure means shown in FIGS. 24 and 25.
Figure 22:
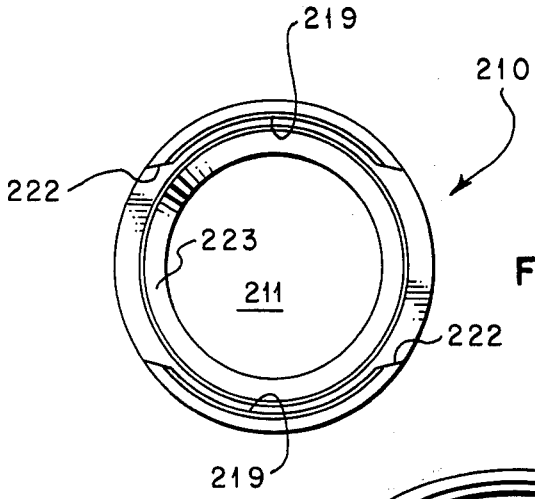
FIG. 22 is an end view of the connector shown in FIG. 21.
Figure 23:
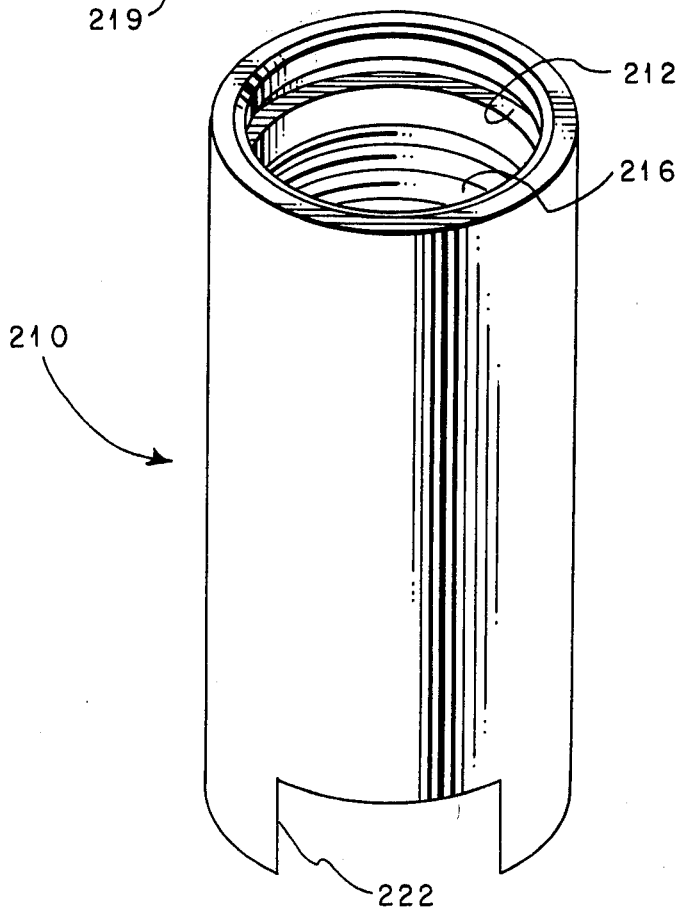
FIG. 23 is an isometric drawing of the connector shown in FIG. 21.
Figure 24:
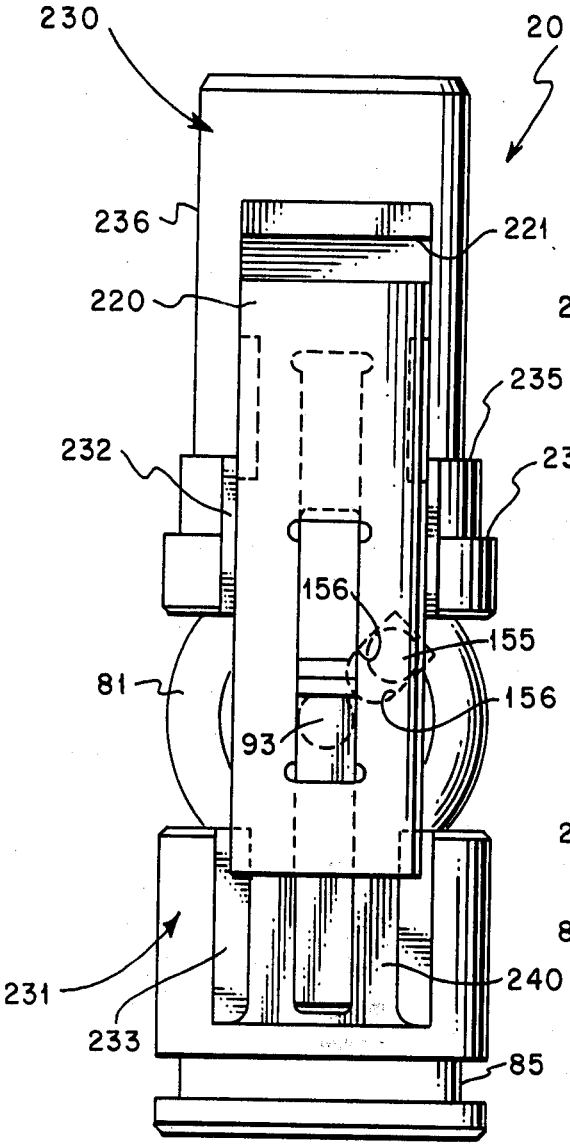
FIG. 24 is a drawing in elevation of the valve closure means used in the embodiment shown in FIGS. 18A–C.
Figure 25:
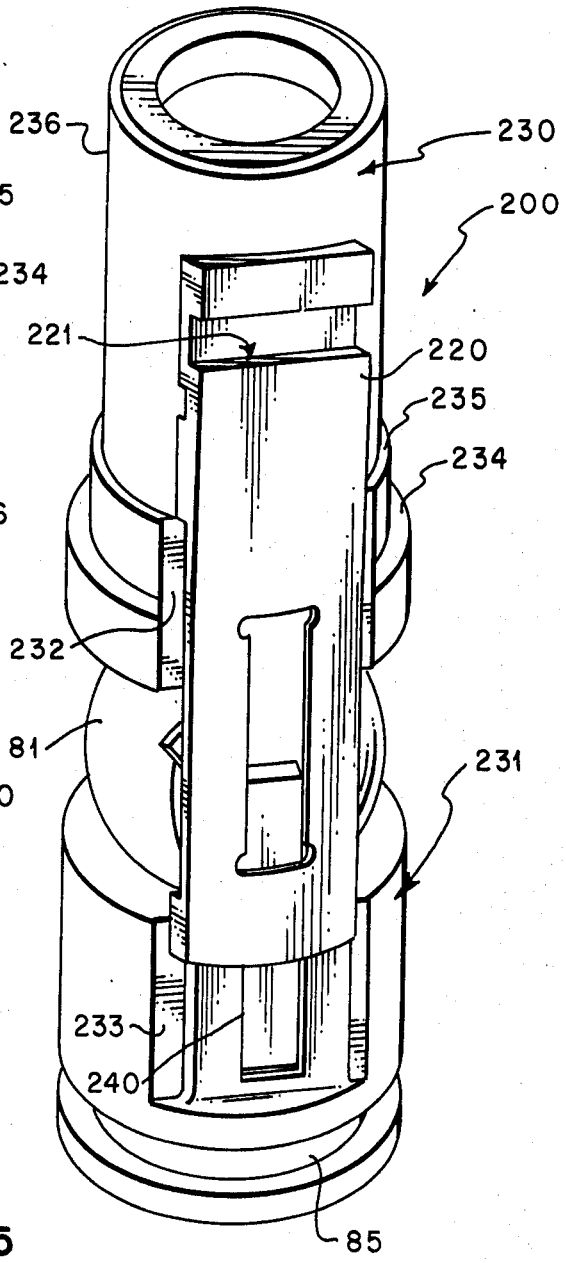
FIG. 25 is an isometric drawing of the valve closure means shown in FIG. 24.

A pair of ball rotating arms 220 are slidably carried on the exterior of valve closure means 200 as best shown in FIGS. 24 and 25. Groove 221 is formed near one end of each arm 220 for attachment with coupling 210. Recess 218 and flange 219, which mate with grooves 221, are provided within bore 211 for attaching arms 220 for coupling 210. For ease of assembly, a pair of slots 222 are machined through flange 219 and recess 218. Slots 222 are spaced radially opposite from each other and sized to receive arms 220 therein. Thus, during assembly of valve 51', coupling 210 is placed over valve closure means 200 with arms 220 positioned in slots 222. Valve closure means 200 is then rotated 90 degrees relative to coupling 210 to engage flange 219 within groove 221 of each arm 220. The engagement between coupling 210 and arms 220 is best shown in FIG. 18B. FIGS. 21, 22 and 23 show details of coupling 210.

Valve closure means 200 has several major components which include previously described ball member 81 with bore 82 therethrough, a pair of ball rotating arms 220, first support ring or seat means 230 and second support ring or seat means 231.

Second support ring 231 is secured within longitudinal flow passage 53' on one side of ball member 81 and has one end resting upon shoulder 58, formed by the end of housing subassembly **51*b* within housing subassembly 51*c*. Groove or recess 85 is formed in the outside diameter of support ring 231** near the one end thereof.

Seal ring 86 similar to seal ring 55 is carried within recess 85. Seal ring 86 forms a fluid tight barrier with the inside diameter of housing means 51' adjacent to support ring 231. Seal ring 86 prevents fluid within longitudinal flow passage 53' from bypassing ball member 81 by flowing between the outside diameter of support ring 231 and the inside diameter of housing means 51'.

First support ring or seat means 230 is secured within longitudinal flow passage 53' on the side of ball member 81 opposite from second support ring 231. Sealing surfaces 88 are formed on the end of each support ring 230 and 231 which contacts the exterior of ball member 81. Sealing surfaces 88 block fluid flow between the ends of support rings or seat means 230 and 231 and the exterior of ball member 81.

Support rings 230 and 231 are generally cylindrical with a bore therethrough. Portions of the exterior of each support ring have been removed to form two flat surfaces 232 and 233, each diametrically opposed and aligned with similar surfaces on ball member 81. Each ball rotating arm 220 has a flat surface which is compatible with and slidable along the flat surfaces of ball member 81 and support rings 230 and 231.

First support ring 230 has a pair of stepped shoulders 234 and 235 formed on its outside diameter near the end which contacts ball member 81. The remainder of outside diameter 236 of support ring 230 is sized to be received within coupling 210 and to form a fluid tight barrier with seal ring 215. A matching curved surface is provided on the interior portion of each arm 220 which contacts support ring 230.

Recess 236 is formed in the inside diameter of housing subassembly **51*c* and sized to receive stop segments 237 therein. Segments 237 have an inwardly projecting profile matching stepped shoulders 234 and 235 on the exterior of support ring 230. The engagement of segments 237 within recess 236 and contact between segments 237 and shoulders 234 and 235 restrict the longitudinal movement of valve closure means 200 within housing means 51'. Segments 237 and shoulders 58 cooperate to secure ball member 81 between first support ring 230 and second support ring 231**.

A pair of pivot arms 240 extend between each support ring 230 and 231 and rotatably secure ball member 81 therebetween. Pivot pins 93 extend inwardly from each pivot arm 240 and engage ball member 81 normal to bore 82. The length of pivot arms 240 and the diameter of ball member 81 are selected to allow ball member 81 to rotate about pivot pins 93 between support rings 230 and 231. Thus, ball member 81 is rotatably secured within longitudinal flow passage 53' and restrained from moving longitudinally therein.

Coupling 210 engages operating sleeve means 60' to arms 220 of valve closure means 200. Each operating arm 220 has an inwardly projecting rotating pin 155. Ball member 81 has recesses 156 formed in its exterior offset from the engagement with pivot pins 93. Recess 156 is sized to receive its respective rotating pin 155 whereby longitudinal movement of operating sleeve means 60' and attached arms 220 will rotate ball member 81 about pivot pins 93. Rotating ball member 81 ninety degrees shifts valve closure means 220 between its first and second positions.

The previously described safety valves 50 and 50' can be readily adapted for use in various flow conductors. The previous description is illustrative of only two embodiments of the present invention. Changes and modifications will be readily apparent to those skilled in the art and may be made without departing from the scope of the invention which is defined in the claims.

What is claimed is:

1. A valve comprising:

a. housing means;

b. a longitudinal flow passage extending through the housing means;

c. valve closure means, disposed within the housing means, having a first position allowing fluid flow through the longitudinal flow passage and a second position blocking fluid flow through the longitudinal flow passage;

d. an operating sleeve means slidably disposed within the longitudinal flow passage and engaging the valve closure means to shift the valve closure means between its first and second positions;

e. a first longitudinal slot formed in the housing means and communicating between the interior and the exterior of the housing means;

f. a first pin means projecting through the first slot and engaging the operating sleeve means;

g. the first pin means being slidable within the first slot and a portion of the pin means extending exterior from the first slot; and h. means for engaging the first pin means with a shifting tool to move the first pin means and operating sleeve means longitudinally with respect to the housing means.

2. A valve, as defined in claim 1, wherein the valve closure means further comprises:

a. a ball member having a bore therethrough;

b. the bore being parallel with and concentric to the longitudinal flow passage when the valve closure means is in its first position and the bore being rotated normal to the longitudinal flow passage when the valve closure means is in its second position;

c. support rings secured within the longitudinal flow passage on opposite sides of the ball members;

d. a sealing surface formed on the end of each support ring which contacts the exterior of the ball member;

e. a pair of pivot arms extending between each support ring and securing the ball member therebetween; and f. a pivot pin extending from each pivot arm, engaging the ball member normal to the axial bore and allowing the ball member to rotate therebetween.

3. A valve, as defined in claim 2, further comprising:

a. a pair of operating arms attached to and extending from the operating sleeve means; and b. each operating arm having a rotating pin engaging the ball member offset from the pivot pins whereby longitudinal movement of the operating sleeve means and attached operating arms rotate the ball member.

4. A valve, as defined in claim 1, further comprising:

a. a cylinder disposed between the exterior of the operating sleeve means and the inside diameter of the housing means;

b. a second longitudinal slot in the cylinder aligned with the first longitudinal slot;

c. packing means disposed around the exterior of the operating sleeve means at each end of the cylinder and engaging the inside diameter of the housing means; and d. the first pin means extending from the operating sleeve means through both first and second slots.

5. A valve, as defined in claim 1, wherein the means for engaging the first pin means further comprises:

a. a link carried by the housing means exterior to the first longitudinal slot;

b. one end of the link rotatably attached to the housing means; and c. the other end of the link engaged with the first pin means.

6. A valve, as defined in claim 5, further comprising:

a. a second pin means secured adjacent to and offset from the first longitudinal slot; p1 b. the link having the one end engaged with the second pin means; and c. the exterior of the link sized for engagement by the shifting tool.

7. A valve, as defined in claim 6, further comprising:

a. the valve closure means having a ball member with a bore therethrough;

b. operating arms attached to and extending from the operating sleeve means;

c. the operating arms engaging the ball member; and d. the ball member rotatably secured within the longitudinal flow passage.

8. A valve, as defined in claim 1, further comprising:

a. the housing means having a generally cylindrical exterior;

b. a portion of the exterior of the housing means removed to form a planar surface;

c. the first longitudinal slot formed within the planar surface;

d. a cover, formed from a segment of a cylinder, having a radius compatible with the exterior of the housing means; and e. means for attaching the cover to the housing means over the planar surface to provide a uniform outside diameter on the housing means.

9. A valve, as defined in claim 8, further comprising:

a. a second pin means attached to the interior of the cover and projecting inwardly towards the planar surface;

b. a link having one end engaged with the second pin means and the other end engaged with the first pin means;

c. an opening between the cover and the planar surface sized to accommodate the shifting tool; and d. the exterior of the link sized for engagement by the shifting tool.

10. A valve comprising:

a. housing means;

b. a longitudinal flow passage extending through the housing means;

c. valve closure means, disposed within the longitudinal flow passage, having a first position allowing fluid flow therethrough and a second position blocking fluid flow through the longitudinal flow passage;

d. an operating sleeve slidably disposed within the longitudinal flow passage and engaging the valve closure means to shift the valve closure means between its first and second positions;

e. longitudinal slots extending partially through the housing means and allowing communication between the longitudinal flow passage and the exterior of the housing means;

f. operating pins slidably disposed within each longitudinal slot and engaging the operating sleeve;

g. means for sealing between the outside diameter of the operating sleeve and the inside diameter of the housing means to block fluid communication between the longitudinal flow passage and the exterior of the housing means through the longitudinal slots; and h. means for engaging each operating pin by a shifting tool and sliding each operating pin and the operating sleeve longitudinally with respect to the housing means to shift the valve closure means between its first and second positions.

11. A valve, as defined in claim 10, wherein the means for engaging each operating pin by a shifting tool further comprises:

a. an opening for the shifting tool in the exterior of the housing means adjacent to each longitudinal slot; and b. a portion of each operating pin extending from its respective longitudinal slot and engageable through each opening by the shifting tool.

12. A valve, as defined in claim 11, wherein the means for engaging said operating pin by a shifting tool further comprises:

a. a link carried by the housing means exterior to each longitudinal slot;

b. one end of each link rotatably attached to the housing means;

c. the other end of each link engaged with one of the operating pins; and d. the exterior of each link sized for engagement by the shifting tool.

13. A valve, as defined in claim 12, further comprising:

a. the valve closure means having a ball member with a bore therethrough;

b. the ball member rotatably secured within the longitudinal flow passage;

c. the bore being parallel with and concentric to the longitudinal flow passage when the valve closure means is in its first position and the bore being rotated normal to the longitudinal flow passage when the valve closure means is in its second position;

d. two operating arms attached to and extending from the operating sleeve; and e. each operating arm engaging the ball member on opposite sides thereof, whereby longitudinal movement of the operating sleeve rotates the ball member.

14. A valve, as defined in claim 13, further comprising:

a. two operating pins engaging the exterior of the operating sleeve spaced radially from each other; and b. the one end of each link rotatably attached to a pivot post carried by the housing means adjacent to each longitudinal slot.

15. A valve, as defined in claim 14, further comprising:

a. support rings secured within the longitudinal flow passage on opposite sides of the ball member;

b. a sealing surface formed on one end of each support ring and each sealing surface contacting the exterior of the ball member;

c. a pair of pivot arms attached to each support ring and securing the ball member therebetween; and d. a pivot pin extending from each pivot arm and engaging the ball member normal to the axial bore.

16. A valve, as defined in claim 15, further comprising each operating arm having a rotating pin engaging the ball member offset from the pivot pins whereby longitudinal movement of the operating sleeve rotates the ball member to shift the valve closure means between its first and second positions.

17. A valve, as defined in claim 11, further comprising:

a. the housing means having a generally cylindrical exterior;

b. portions of the exterior of the housing means removed to form two planar surfaces radially spaced on opposite sides of the housing means;

c. each longitudinal slot formed in a separate planar surface;

d. covers, each formed from a segment of a cylinder, having a radius compatible with the exterior of the housing means;

e. means for attaching each cover to the housing means over its respective planar surface to provide a uniform outside diameter on the housing means; and f. the openings for the shifting tool between the interior of the cover and its respective planar surface.

18. A valve, as defined in claims 1 or 10, wherein the valve closure means further comprises a detent spring to indicate when the valve closure means has completed movement between its first and second position.

19. A valve, as defined in claims 1 or 10, further comprising means for attaching each end of the housing means to a flow conductor.

20. A valve comprising:

a. housing means;

b. a longitudinal flow passage extending through the housing means;

c. the housing means having a generally cylindrical exterior with two partially planar surfaces formed therein and spaced radially from each other;

d. a cover for each planar surface;

e. the exterior of each cover having a radius compatible with the radius of the exterior of the housing means;

f. means for securing each cover to the housing means to provide an opening between the respective cover and planar surface and a uniform outside diameter for the housing means;

g. means for securing each end of the housing means to a flow conductor;

h. a longitudinal slot formed through each planar surface and communicating with the longitudinal flow passage;

j. an operating sleeve disposed within the longitudinal flow passage;

j. operating pins attached to the exterior of the operating sleeve with each operating pin projecting through one of the longitudinal slots;

k. the operating sleeve and operating pins being slidable longitudinally relative to the housing means;

l. pivot posts affixed to the housing means adjacent to and offset from each longitudinal slot;

m. a link connecting each operating pin to the adjacent pivot post;

n. valve closure means disposed within the longitudinal flow passage having a first position allowing fluid flow therethrough and a second position blocking fluid flow through the longitudinal flow passage;

o. means for attaching the operating sleeve to the valve closure means to allow the operating sleeve to shift the valve closure means between its first and second position; and p. means for sealing between the exterior of the operating sleeve and the inside diameter of the housing means to block fluid communication through the longitudinal slots.

21. A valve, as defined in claim 20, further comprising each pivot post formed on the interior of one of the covers and projecting inwardly toward its respective planar surface.

22. A valve, as defined in claim 20, further comprising:

a. one end of each link engaged with one pivot post and the other end of the same link engaged with the adjacent operating pin;

b. the link sized to be slidable between the interior of the cover and the respective planar surface; and c. the opening between each cover and its respective planar surface sized to allow insertion of the shifting tool.

23. A valve, as defined in claim 20, further comprising:

a. the valve closure means having a ball member with a bore therethrough;

b. the bore being parallel with and concentric to the longitudinal flow passage when the valve closure means is in its first position and being rotated normal to the longitudinal flow passage when the valve closure means is in its second position;

c. support rings secured within the longitudinal flow passage on opposite sides of the ball member;

d. a sealing surface formed on the end of each support ring which contacts the exterior of the ball member;

e. a pair of pivot arms extending between each support ring and securing the ball member therebetween;

f. a pivot pin extending from each pivot arm and engaging the ball member normal to the axial bore; and g. the means for attaching the operating sleeve to the valve closure means including a pair of operating arms attached to and extending from the operating sleeve with each operating arm having a rotating pin engaging the ball member offset from the pivot pin whereby longitudinal movement of the operating sleeve and attached operating arms rotates the ball member.

24. A valve, as defined in claim 23, further comprising:

a. each operating arm spaced adjacent to and slidable relative to one of the pivot arms;

b. a detent spring carried within a recess in each pivot arm;

c. a boss on each detent spring contacting the adjacent operating arm;

d. a first notch on each operating arm corresponding to the first position of the valve closure means and a second notch on each operating arm corresponding to the second position of the valve closure means; and e. each notch sized to receive the boss on the detent spring.

25. A valve comprising:

a. housing means;

b. a longitudinal flow passage extending through the housing means;

c. valve closure means, disposed within the longitudinal flow passage, having a first position allowing fluid flow therethrough and a second position blocking fluid flow through the longitudinal flow passage;

d. an operating sleeve slidably disposed within the longitudinal flow passage and engaging the valve closure means to shift the valve closure means between its first and second positions;

e. longitudinal slots extending partially through the housing means and allowing communication between the longitudinal flow passage and the exterior of the housing means;

f. operating pins slidably disposed within each longitudinal slot and engaging the operating sleeve;

g. means for sealing between the outside diameter of the operating sleeve and the inside diameter of the housing means to block fluid communication between the longitudinal flow passage and the exterior of the housing means through the longitudinal slots;

h. means for engaging said operating pin by a shifting tool and sliding each operating pin and the operating sleeve longitudinally with respect to the housing means to shift the valve closure means between its first and second positions;

i. the valve closure means having a ball member with a bore therethrough;

j. the ball member rotatably secured within the longitudinal flow passage;

k. the bore being parallel with and concentric to the longitudinal flow passage when the valve closure means is in its first position and the bore being rotated normal to the longitudinal flow passage when the valve closure means is in its second position;

l. a pair of ball rotating arms engaging the ball member on opposite sides thereof whereby longitudinal movement of the arms rotates the ball member;

m. a coupling for transmitting longitudinal movement of the operating sleeve to the rotating arms;

n. first and second support rings secured within the longitudinal flow passage on opposite sides of the ball member;

o. a sealing surface formed on one end of each support ring and each sealing surface contacting the exterior of the ball member;

p. a pair of pivot arms between each support ring and securing the ball member therebetween; and q. a pivot pin extending from each pivot arm and engaging the ball member normal to its axial bore.

26. A valve, as defined in claim 25, further comprising:

a. means for forming a fluid tight seal between the coupling and its adjacent support ring;

b. means for forming a fluid tight seal between the coupling and the operating sleeve; and c. the effective area of both seal means being equal to the effective area of the seal means between the operating sleeve and the housing means.

27. A valve, as defined in claim 25, further comprising:

a. stop shoulders on the exterior of the first support ring;

b. stop segments secured within the housing means; and c. the stop segments having a profile matching the stop shoulders and projecting inwardly to contact the stop shoulders whereby longitudinal movement of the valve closure means within the flow passage is restricted.

* * * * *